US007914353B2

(12) United States Patent
Kobayashi et al.

(10) Patent No.: US 7,914,353 B2
(45) Date of Patent: Mar. 29, 2011

(54) SPARK PLUG AND METHOD FOR MANUFACTURING THE SAME

(75) Inventors: Kenji Kobayashi, Aichi (JP); Makoto Yamaguchi, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 392 days.

(21) Appl. No.: 12/038,045

(22) Filed: Feb. 27, 2008

(65) Prior Publication Data

US 2008/0203882 A1 Aug. 28, 2008

(30) Foreign Application Priority Data

Feb. 27, 2007 (JP) ..... 2007-047146

(51) Int. Cl.
*H01T 21/02* (2006.01)

(52) U.S. Cl. ..... 445/7; 313/118

(58) Field of Classification Search ..... 313/11.5, 313/118, 144; 445/7
See application file for complete search history.

(56) References Cited

U.S. PATENT DOCUMENTS

| | | | | |
|---|---|---|---|---|
| 2,041,136 | A * | 5/1936 | Klingner | 313/11.5 |
| 2,941,105 | A | 6/1960 | Rickenbach | 313/118 |
| 7,291,961 | B2 | 11/2007 | Suzuki et al. | 313/141 |
| 7,449,824 | B2 * | 11/2008 | Moribe et al. | 313/144 |
| 7,477,006 | B2 * | 1/2009 | Fukuzawa et al. | 313/118 |
| 2004/0066124 | A1 | 4/2004 | Kanao et al. | 313/135 |

FOREIGN PATENT DOCUMENTS

| | | |
|---|---|---|
| JP | S49-32030 | 3/1974 |
| JP | S50-24148 | 3/1975 |
| JP | 60-139909 | 7/1985 |
| JP | 200133410 | 5/2000 |
| JP | 2003297525 | 10/2003 |
| JP | 2005123182 | 5/2005 |

OTHER PUBLICATIONS

European Search Report, mailed on May 8, 2008, from corresponding European Patent Application No. 08102071.1; 6 pages.

* cited by examiner

*Primary Examiner* — Nimeshkumar D Patel
*Assistant Examiner* — Mary Ellen Bowman
(74) *Attorney, Agent, or Firm* — Kusner & Jaffe

(57) ABSTRACT

A method for manufacturing a spark plug and a spark plug manufactured by the method in which a gasket used for securing the air-tightness when mounting the spark plug on an internal-combustion engine is prevented from falling out from the metal shell with a simple step.

4 Claims, 10 Drawing Sheets

SPARK PLUG AND METHOD FOR MANUFACTURING THE SAME

FIELD OF THE INVENTION

The present invention relates to a method for manufacturing a spark plug mounted in an internal-combustion engine so as to ignite an air-fuel mixture, and to a spark plug manufactured by the method.

BACKGROUND OF THE INVENTION

A conventional spark plug for an internal-combustion engine is comprised of: a center electrode in which a front end thereof serves as an electrode for spark discharge; an insulator having an axial bore and accommodating the center electrode in a front end of the axial bore; and a metal shell surrounding and holding the insulator in a radial direction thereof. A male thread portion is formed on a front end side outer surface of the metal shell so as to engage with a threaded hole of an internal-combustion engine. Then, a spark is discharged in the internal-combustion engine to thereby ignite an air-fuel mixture.

The metal shell of such a spark plug typically includes an outward projection portion disposed toward a rear end side with respect to the fitting thread portion. An annular-shaped hollow gasket is disposed on a locating portion formed between the seal portion and the fitting thread portion. The hollow gasket is sandwiched between the surface of the engine block that surrounds the threaded hole therein and the seal portion of the metal shell when the spark plug is mounted on an internal-combustion engine. The hollow gasket is deformed to thereby improve its sealing properties and prevent the air leakage of the combustion chamber through the fitting threaded hole. Such a hollow gasket is produced by, for example, radially bending a ring-like plate member into an "S" shaped or a "C" shaped cross-section. As a result, the gasket is easily deformed when mounting the spark plug, and its sealing properties may be maintained after being deformed.

In the manufacturing process of the spark plug, the hollow gasket is inserted from the front end side of the metal shell having a thread ridge in the fitting thread portion, which is subjected to a cutting process, and is disposed on the locating portion. At this time, plural parts of an inner edge of the hollow gasket is compressed in an axial direction so as to form a nail-like portion, which radially inwardly projects with respect to a portion serving as the maximum outer diameter of the fitting thread portion. As a result, the gasket is retained on the metal shell and is prevented from falling from the metal shell over the fitting thread portion (e.g., refer to Patent Document 1).

In recent years, the improvement in an output of an automobile engine and fuel efficiency are highly in demand, and further improvement in spark plug components is also required. Regarding a gasket, a flat solid gasket assuming a thick disc shape and comprised of an alloy, which is mainly made of copper or the like, is considered. One of the advantages of using such a flat solid gasket is that after being once mounted on the engine, the spark plug is unlikely to loosen. Further, because such a gasket is a flat solid member, it is unlikely to be crushed. Furthermore, the position of the front end of the center electrode within the combustion chamber, with respect to an axis of the fitting threaded hole, is unlikely to vary, thereby stabilizing an igniting position.

In the manufacturing process of the spark plug using the flat solid gasket, in order to prevent the flat solid gasket from falling out from the metal shell, for example, a pipe shaped pressing member having an inner diameter slightly lager than the maximum outer diameter of the thread ridge is provided from the front end side of the metal shell in a state that the flat solid gasket is disposed on the locating portion of the metal shell in which the fitting thread portion has already been formed. Further, a front end opening of the pressing member being in contact with the flat solid gasket is pressed against the seal portion. As a result, the inner edge of the flat solid gasket radially inwardly projects from a portion serving as the maximum outer diameter of the fitting thread portion.

However, in the manufacturing process of a spark plug, since there is no large difference in diameters between an inner circumference of a pressing member and a thread ridge of a fitting thread portion of the metal shell when disposing a gasket on an locating portion of a metal shell after a thread rolling and processing for preventing a falling out of a gasket, and there is a tendency of producing a chip of the thread ridge. In order to prevent a loosening of a spark plug, the hardness of the gasket is necessary to be raised. However, when such a gasket is used, a pressing force against the gasket using a pressing member during a process of preventing the falling out of the gasket needs to be increased. As a result, a durability of a pressing member decrease, thereby causing a rise of a production cost.

An advantage of the present invention is a method for manufacturing a spark plug, and a spark plug manufactured by the method, wherein a gasket used for securing the air-tightness between the spark plug and an internal-combustion engine is prevented from falling from the metal shell of the spark plug with a simple step.

SUMMARY OF THE INVENTION

In order to solve the above problems, there is provided a method for manufacturing a spark plug according to a first aspect of the invention comprising: a center electrode; an insulator having an axial bore which extends in an axial direction and holding the center electrode in a front end side of the axial bore; and a metal shell surrounding and holding a radial circumference of the insulator and having a male-screw-shaped fitting thread portion formed on a front end side outer circumference face of the metal shell, a seal portion formed so as to radially outwardly project at a rear end side with respect to the fitting thread portion, and a locating portion formed between the seal portion and the fitting thread portion, where an annular gasket is disposed so as to seal between an opening peripheral portion of a fitting threaded hole of an internal-combustion engine and the seal portion when screwing the fitting thread portion into the fitting threaded hole, wherein the method for manufacturing a spark plug comprising the steps of: a cylindrical member formation step for forming a cylindrical member which serves as an original form of the metal shell and where the seal portion and the locating portion are formed but no fitting thread portion is formed; a gasket locating step for disposing the gasket on an outer circumference face of the cylindrical member after the cylindrical member formation step; and a fitting thread portion formation step for forming a fitting thread portion with a thread rolling on a thread forming portion of the cylindrical member after the gasket locating step.

In accordance with a second aspect of the invention, there is provided a method for manufacturing a spark plug as described above, wherein the gasket disposed on the outer circumferential face of the cylindrical member is pressed towards the seal portion with a die that is used for thread rolling, the gasket being disposed on the locating portion prior to a thread format step.

In accordance with a third aspect of the invention, there is provided a method for manufacturing a spark plug as described above, wherein an inner diameter of the gasket is larger than an outer diameter of the thread forming portion, and wherein a maximum outer diameter of the thread ridge after the fitting thread portion formation step is larger than the inner diameter of the gasket.

In accordance with a fourth aspect of the present invention, there is provided a method for manufacturing a spark plug, wherein the gasket is an annular plate.

In accordance with a fifth aspect of the invention, there is provided a spark plug manufactured by a method according to any one of the above aspects.

In the method for manufacturing a spark plug according to the first aspect, the thread ridge is formed on the thread-forming portion of the metal shell after the gasket is positioned on the outer circumferential face of the cylindrical member of the original form of the metal shell. Thus, an inner edge of the gasket is caught by the thread ridge after the thread rolling process. As a result, the gasket is retained on and does not fall from the fitting thread portion, thereby preventing the gasket from falling from the metal shell. Since a separate process to secure the gasket is not necessary after positioning the gasket on the locating portion of the metal shell, the production costs are reduced and the manufacturing process is simplified. As a result, the spark plug can be offered with a reasonable price.

According to the second aspect of the present invention, the die used for threading the thread ridge is also used to press the gasket on the locating portion of the metal shell. The gasket locating step and the fitting thread portion formation step can be performed in series. Thus, reduction in the production cost along with simplifying the manufacturing process of the spark plug can be achieved. As a result, the spark plug can be offered with a reasonable price. Further, since the gasket is disposed on the locating portion using the die, it can save any additional labor to dispose the gasket on the locating portion in the gasket locating step.

With respect to the third aspect of the present invention, the gasket is slid over the thread forming portion from a front end side of a cut body and is located on the locating portion of the cut body before the thread ridge is formed. After threading the thread ridge, the edge portion of the inner circumference of the gasket is captured by the formed screw thread whereby the gasket cannot fall from the locating portion.

With respect to the fourth aspect of the present invention, since the gasket does not require a separate manufacturing process to prevent it from falling from the shell, it is easy to secure a gasket even if a flat solid gasket made of an intractable plate material is used for the spark plug. Furthermore, when mounting a spark plug that has such a flat solid gasket on an internal-combustion engine, loosening of the spark plug as a result of vibrations of the internal-combustion engine can be prevented. Moreover, since the gasket deforms only slightly, the position of the front end of the center electrode within a combustion chamber, with respect to an axis of the fitting threaded hole, is unlikely to vary, thereby stabilizing an ignition position.

With respect to the fifth aspect of the invention, a spark plug manufactured according to the method of any one of above aspects, the gasket is unlikely to separate, i.e., fall from the metal shell.

DETAILED DESCRIPTION OF PREFERRED EMBODIMENTS

Figure 1:
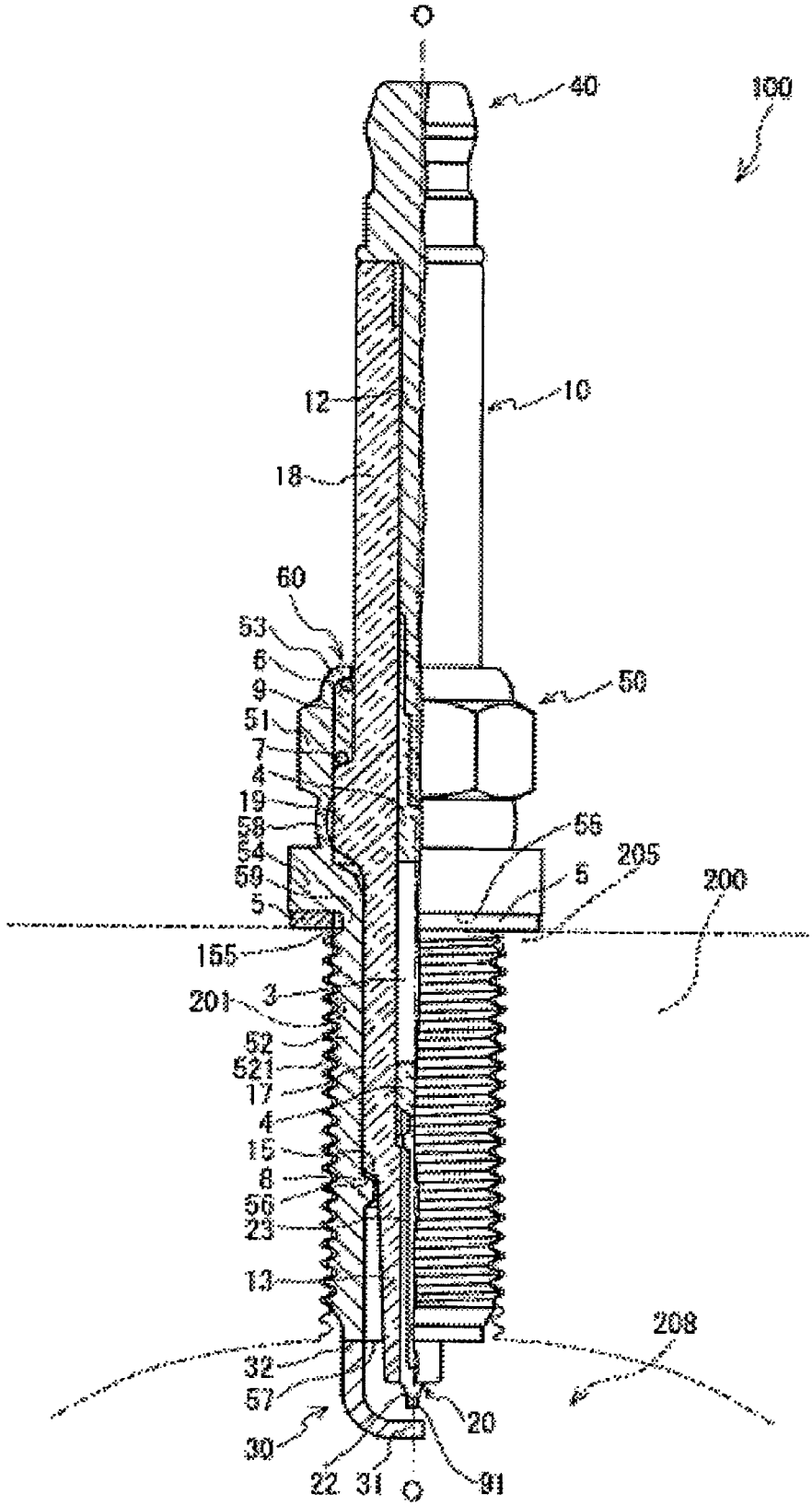
FIG. 1 is a partial cross sectional view of a spark plug 100.

Hereafter, an embodiment of a method for manufacturing a spark plug and a spark plug manufactured by the method which carries out the present invention will be described with reference to the drawings. First, referring to FIG. 1, a composition of a spark plug 100 will be explained as an example of the spark plug produced by the method according to the present invention. FIG. 1 is a partial cross-sectional view of a spark plug 100. In FIG. 1, the direction of axis "O" of spark plug 100 is regarded as the top-to-bottom direction in the drawing. A lower side of the drawing is regarded as a front end side of spark plug 100 and an upper side of the drawing is regarded as a rear end side of spark plug 100.

As shown in FIG. 1, the spark plug 100 is generally comprised of: an insulator 10; a metal shell 50 holding the insulator 10 therein; a center electrode 20 being held in the insulator 10 in an axis "O" direction; a ground electrode 30 having a base end portion 32 welded to a front end face 57 of the metal shell 50 and a front end portion 31 where a side face thereof faces a front end portion 22 of the center electrode 20; and a metal terminal fitting 40 provided at a rear end portion of the insulator 10.

First, the insulator 10 constituting an insulator of the spark plug 100 will be explained. The cylindrical insulator 10 includes an axial bore 12 extending along an axis "O." Insulator 10 is made of sintered alumina or the like as is commonly known. A flange portion 19 having the largest outer diameter is formed generally at a central location along the axis "O." A rear end side body portion 18 is formed at the rear end side (upper side in FIG. 1) with respect to the flange portion 19. A front end side body portion 17 having a smaller outer diameter than that of the rear end side body portion 18 is formed at the front end side (lower side in FIG. 1) with respect to the flange portion 19. An elongated leg portion 13 having a smaller outer diameter than that of the front end side body portion 17 is formed at the front end side with respect to the front end side body portion 17. The diameter of the long leg portion 13 is gradually tapered towards the front end side. The elongated leg portion 13 is exposed to a combustion chamber 208 when the spark plug 100 is mounted on an engine head 200. A step portion 15 is formed between the elongated leg portion 13 and body portion 17.

Next, the center electrode 20 is made of a nickel-system alloy or the like, such as, by way of example and not limitation, INCONEL (trade name) 600 or 601 in which a metal core 23 comprised of copper or a like metal with excellent thermal conductivity is provided. The front end portion 22 of the center electrode 20 projects from the front end face of the insulator 10 and is tapered towards the front end side. A noble metal tip 91 is welded to a front end face of the front end portion 22 so as to improve resistance to spark erosion. Further, the center electrode 20 is electrically connected to the metal terminal fitting 40 at the rear end side through a conductive seal material 4 and a ceramic resistance 3 both provided inside the axial bore 12. A high-tension cable (not shown) is connected to the metal terminal fitting 40 through a plug cap (not shown), to which high voltage is applied.

Next, the ground electrode 30 will be described. The ground electrode 30 is comprised of a metal having an excellent corrosion resistance. As one of the examples, a nickel-system alloy such as INCONEL (trade name) 600 or 601 is used. The ground electrode 30 has a generally rectangular shape as seen from the cross-section in the longitudinal direction. The base end portion 32 of ground electrode 30 is welded to the front end face 57 of the metal shell 50. The free end portion 31 of the ground electrode 30 is bent so that a side face thereof faces the front end portion 22 of the center electrode 20.

Next, the metal shell 50 will be described. The metal shell 50 is a tubular metal fitting for fixing the spark plug 100 to the engine head 200 of an internal-combustion engine. The metal shell 50 holds therein the insulator 10 so as to surround an area from a part of the rear end side body portion 18 to the long leg portion 13. The metal shell 50 is comprised of a low carbon steel material and includes a tool engagement portion 51, dimensioned to engage with a spark plug wrench (not shown), and a fitting thread portion 52 having a thread ridge 521 dimensioned to engage with a threaded hole 201 in the engine head 200 provided in an upper part of the internal-combustion engine.

A flange-like seal portion 54 is formed between the tool engagement portion 51 and the thread portion 52 of the metal shell 50. A locating portion 59 where a gasket 5, which will be mentioned later, is to be disposed between a formation starting position 155, which is formed in a rear end of the fitting thread portion 52 (i.e., the rear end of the thread ridge 521 formed in the fitting thread portion 52), and a seat face 55 (a face facing the front end side) of the seal portion 54. A thin caulking portion 53 is formed at the rear end side with respect to the tool engagement portion 51 of the metal shell 50. Similar to the caulking portion 53, a thin buckling portion 58 is formed between the seal portion 54 and the tool engagement portion 51. Annular ring members 6, 7 lie between an inner circumference face of the metal shell 50 where the tool engagement portion 51 and the caulking portion 53 are formed and an outer circumference face of the rear end side body portions 18 of the insulator 10. Further, talc powder 9 is filled between both ring members 6, 7. The insulator 10 extends through the ring members 6, 7 and the talc 9 and is pressed towards the front end side of the metal shell 50 by inwardly caulking an end portion 60 of the caulking portion 53. Thus, in the screw portion 52 of the metal shell 50, a step portion 56 projects inwardly and supports the step portion 15 of the insulator 10 through an annular packing 8, thereby integrating the metal shell 50 and the insulator 10. At this time, the air-tightness between the metal shell 50 and the insulator 10 is maintained by the packing 8, thereby preventing combustion gas from flowing out. The buckling portion 58 is formed so as to outwardly deform with an application of compression force at the time of a caulking process.

Figure 2:
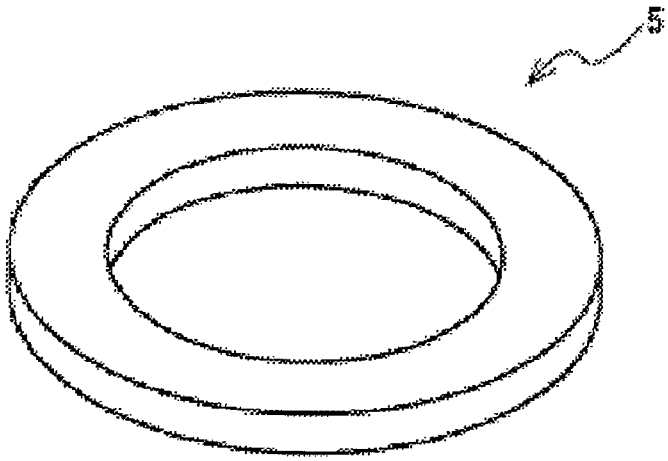
FIG. 2 is a perspective view of a gasket 5.
Figure 3:
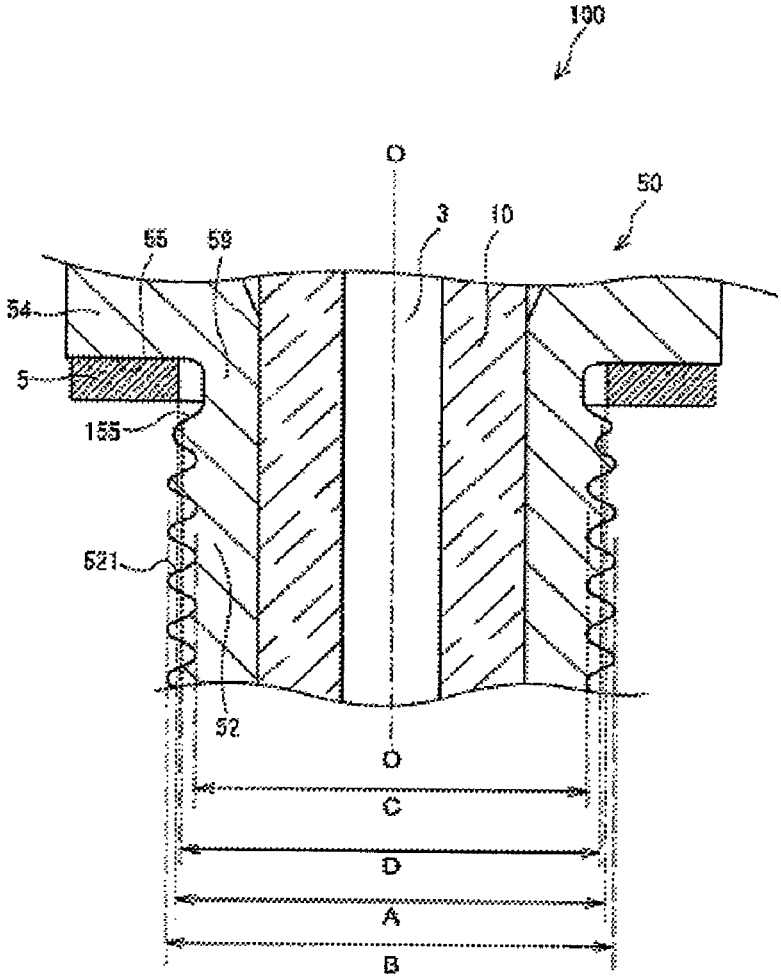
FIG. 3 is an enlarged sectional view of a vicinity of a locating portion 59 of a metal shell 50.

Next, the assembly of the gasket 5 will be described with reference to FIGS. 1 to 3. FIG. 2 is a perspective view of the gasket 5. FIG. 3 is an enlarged sectional view of a vicinity of the locating portion 59 of the metal shell 50.

The gasket 5 shown in FIG. 2 is an annular flat solid packing and is formed by a punching process from a plate-like material made of copper, or an alloy comprised mainly of copper. As shown in FIG. 3, the gasket 5 is disposed on the locating portion 59 of the metal shell 50. As shown in FIG. 1, when the spark plug 100 is mounted on the engine head 200, the gasket 5 is interposed between the seat face 55 of the seal portion 54 and an opening peripheral portion 205 of the fitting threaded hole 201 of the engine head 200 where the fitting thread portion 52 is engaged. With the tightening of the fitting thread portion 52 at the time of a mounting process, a surface (contact face) of the gasket 5, which is in contact with the seat face 55 of the seal portion 54 and the opening peripheral portion 205 of the fitting threaded hole 201, is plastically deformed. As a result, the gasket 5 adheres to the seat face 55 and the opening peripheral portion 205, and forms a seal therebetween thereby preventing an air leak from the engine through the fitting threaded hole 201.

Figure 5:
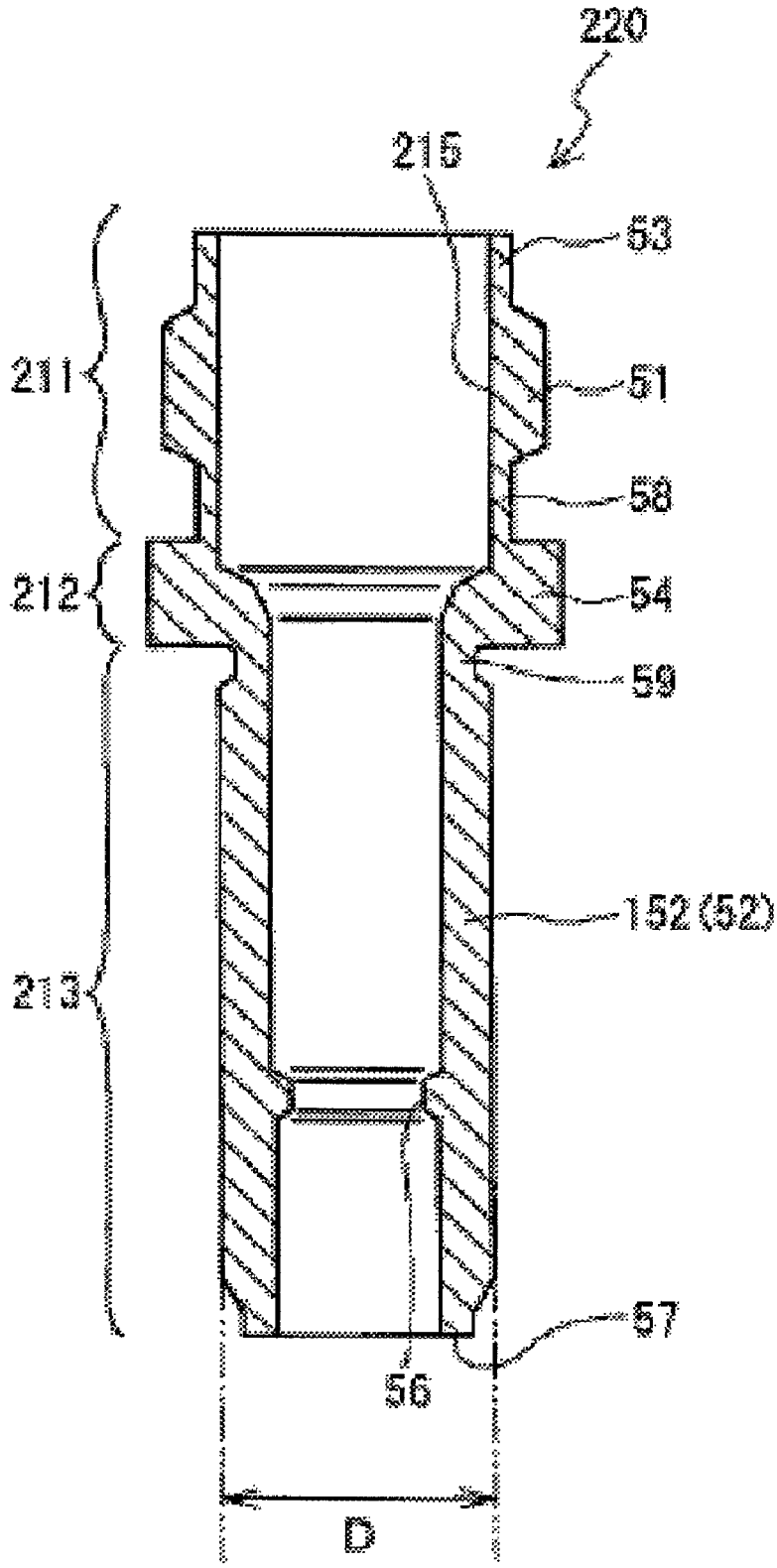
FIG. 5 shows a cutting step of the manufacturing process of the spark plug 100.

As shown in FIG. 3, the annular-shaped gasket 5 has an inner diameter A that is smaller than an outer diameter of a portion B (hereinafter referred to as a "crest diameter") serving as the maximum outer diameter of the fitting thread portion 52 (i.e., the crest of the thread ridge 521) and that is larger than an outer diameter C (hereinafter referred to as a "core diameter" or "root diameter") of a portion serving as the minimum outer diameter of the fitting thread portion 52 (i.e., a bottom portion between the thread ridge 521). In the manufacturing process of the metal shell 50 of the spark plug 100, which will be mentioned later, the thread ridge 521 of the fitting thread portion 52 is formed by a thread rolling process. Before the thread ridge 521 is formed, metal shell 50 begins as a cut body 220, as shown in FIG. 5. The thread forming portion 152 of cut body 220 has an outer diameter D (hereinafter referred to as a "blank diameter") (the outline is shown with a dotted line in FIG. 3) that becomes the fitting thread portion 52 after the thread rolling process. Blank diameter D is generally equal to an effective diameter of the thread ridge 521. Once the thread ridge 521 is formed, the crest diameter B of thread ridge 521 is larger than the blank diameter D, and the core diameter C of thread ridge 521 is smaller than the blank diameter D. The effective diameter of the thread ridge 521 and the crest diameter B and the core diameter C may vary depending on a material of the metal shell 50, a specification of a rolling die (thread rolling cylindrical dies 300, 310 will be mentioned later) and/or pressing conditions at the time of the thread rolling or the like. In this embodiment, each diameter is defined according to the above conditions so as to meet a requirement of: the crest diameter B>the inner diameter A>the blank diameter D>the core diameter C. By forming cut body 220 and gasket 5 as described above, the gasket 5 may be slid over the thread forming portion 152 of the cut body 220 (referred to in FIG. 5) from the front end side, and be located on the locating portion 59 before forming the thread ridge 521. After the thread ridge 521 is formed, the edge portion of the inner circumference of the gasket 5 is captured by the thread ridge 521, whereby the gasket 5 is retained on the metal shell 50 and cannot fall from the locating portion 59. The seal portion 54 that is formed in the rear end of the locating portion 59, prevents the gasket 5 from moving towards the rear end side. Thus, the gasket 5 is unlikely to move towards a rear end side of the metal shell 50, thereby preventing the gasket 5 from falling from the metal shell 50. In other words, gasket 5 is captured on metal shell 50 between the formed thread ridge 521 and seal portion 54.

Figure 9:
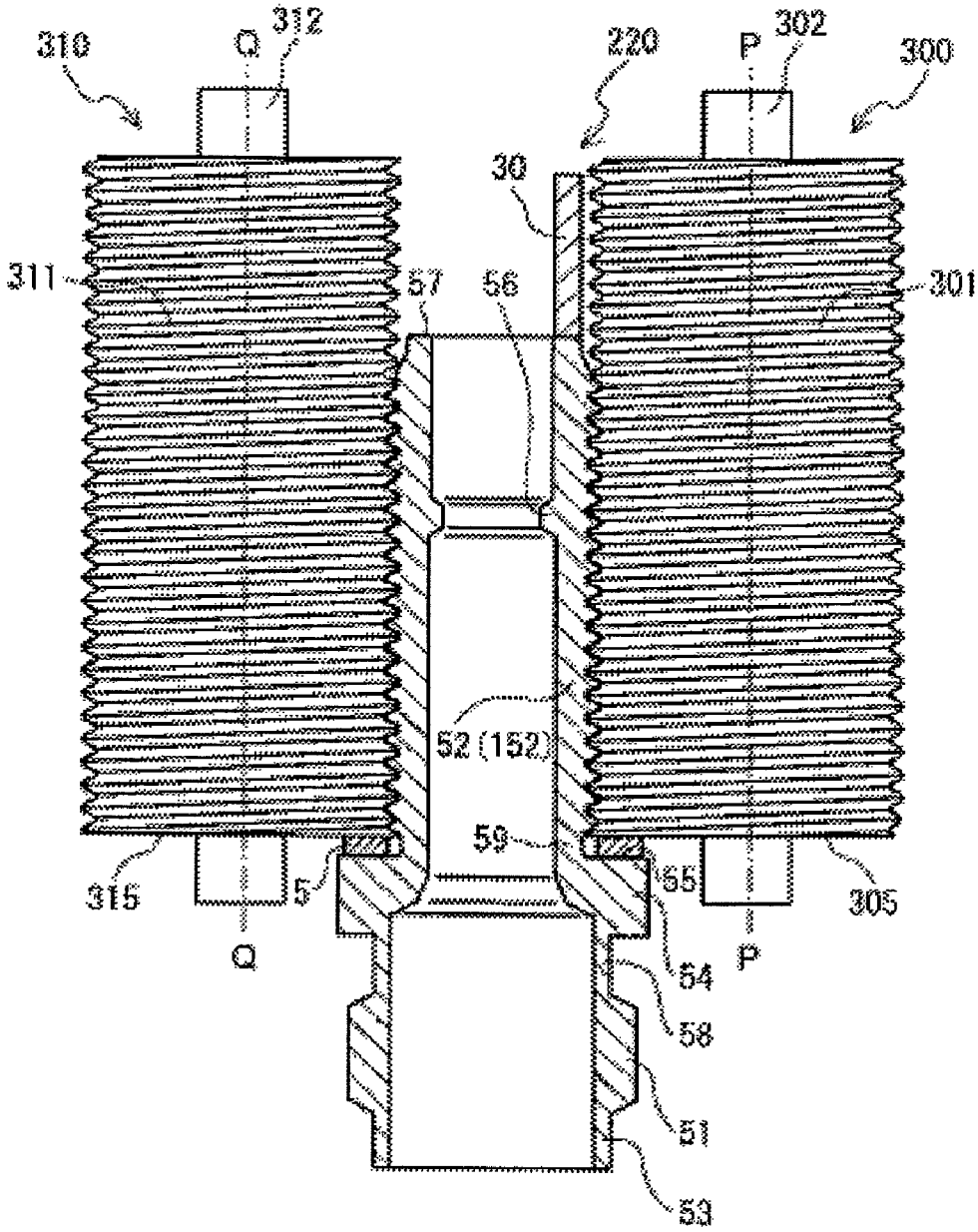
FIG. 9 shows a second thread rolling step of the manufacturing process of the spark plug 100.

In the manufacturing process of the spark plug 100 having such a composition, in this embodiment, the thread ridge 521 is formed along the thread forming portion 152 of metal shell 50 after disposing the gasket 5 on the locating portion 59 of the metal shell 50. In this respect, the metal shell 50 is formed so as to satisfy the aforementioned size requirements (i.e., crest diameter B of the fitting thread portion 52>inner diameter A of the gasket 5). Thus, the gasket 5 is prevented from falling off of the metal shell 50. Although the thread ridge 521 is formed in a second thread rolling step of the manufacturing process of the spark plug 100, which will be mentioned later, the composition of the thread rolling cylindrical dies 300, 310 used for threading the thread ridge 521 in the thread forming portion 152 of the metal shell 50 will be briefly described with reference to FIG. 9. FIG. 9 shows the second thread rolling step of the manufacturing process of the spark plug 100.

As shown in FIG. 9, the thread rolling cylindrical dies 300, 310 are provided so that an axis line P of a rotation shaft 302 and an axis line Q of a rotation shaft 312 are parallel with the axis O of the cut body 220. The rotation shafts 302, 312 are movable toward each other in a direction where the axis P and the axis Q can tie together (i.e., a horizontal direction in FIG. 9) and also are movable in a direction along each axis P and Q (up-and-down or vertical direction in FIG. 9). The thread rolling cylindrical dies 300, 310 have processing faces 301, 311, respectively. A thread-shaped processing tooth is formed on the whole outer circumference of each face 301, 311. Dies 300, 310 are rotated in the same direction by a rotation means (not illustrated) at a predetermined speed. One end of the cylindrical, thread rolling dies 300, 310 includes end faces 305, 315. End faces 305, 315 face toward the rear end side of the cut body 220, which is disposed between the thread rolling cylindrical dies 300, 310. End faces 305, 315 are planar in shape and are perpendicular to the each axis P and Q.

Figure 4:
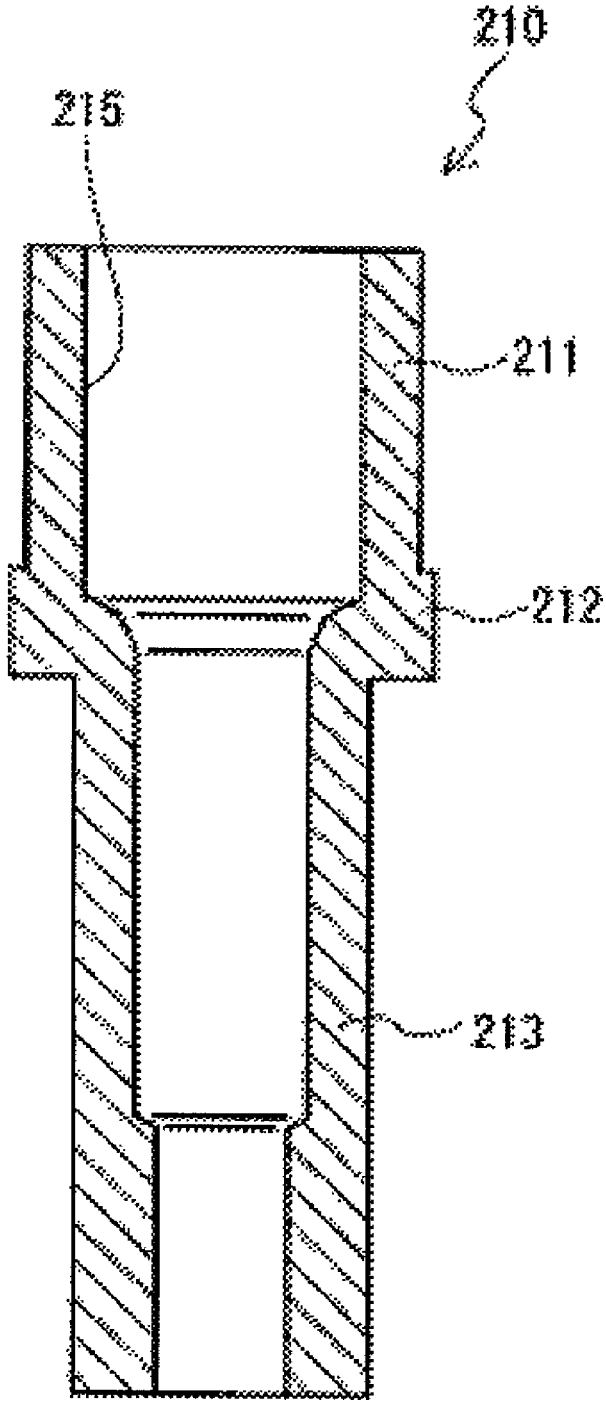
FIG. 4 shows a forging step of a manufacturing process of the spark plug 100.
Figure 6:
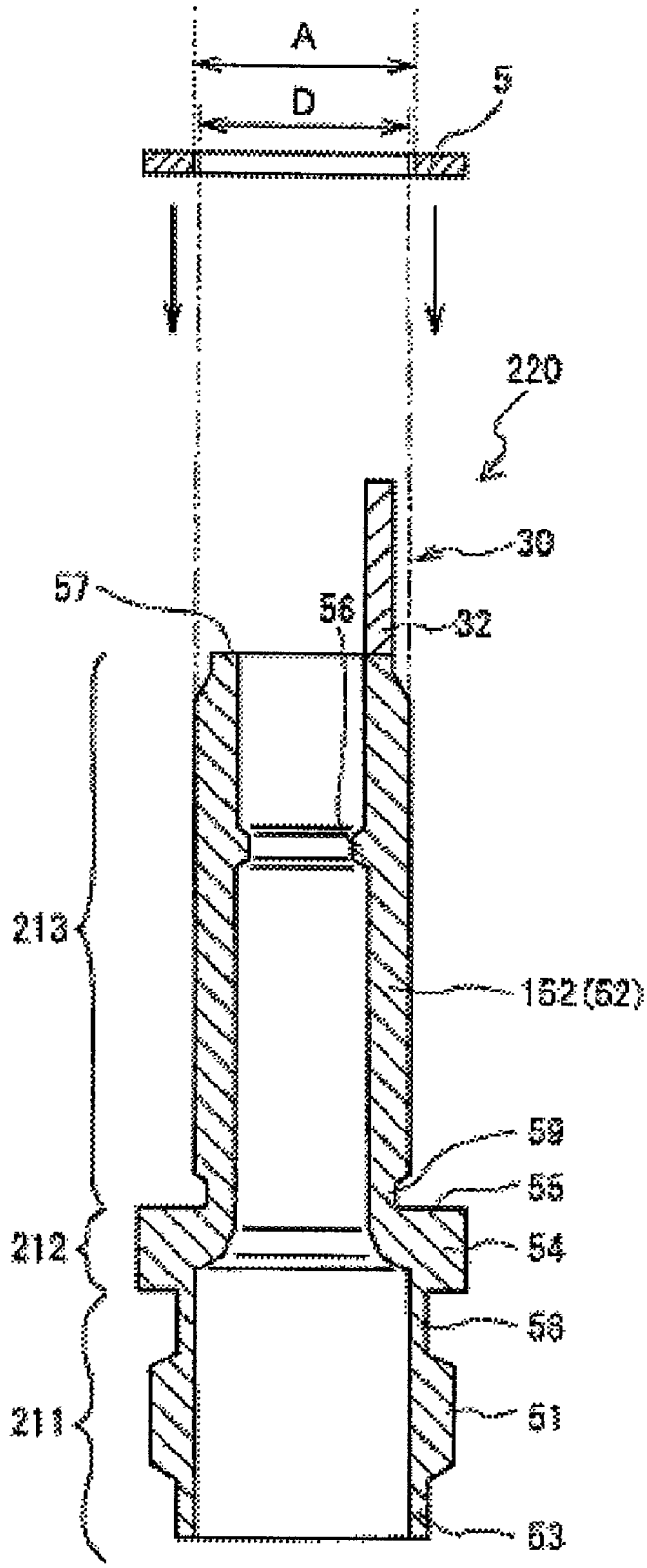
FIG. 6 shows a gasket locating step of the manufacturing step of the spark plug 100.
Figure 7:
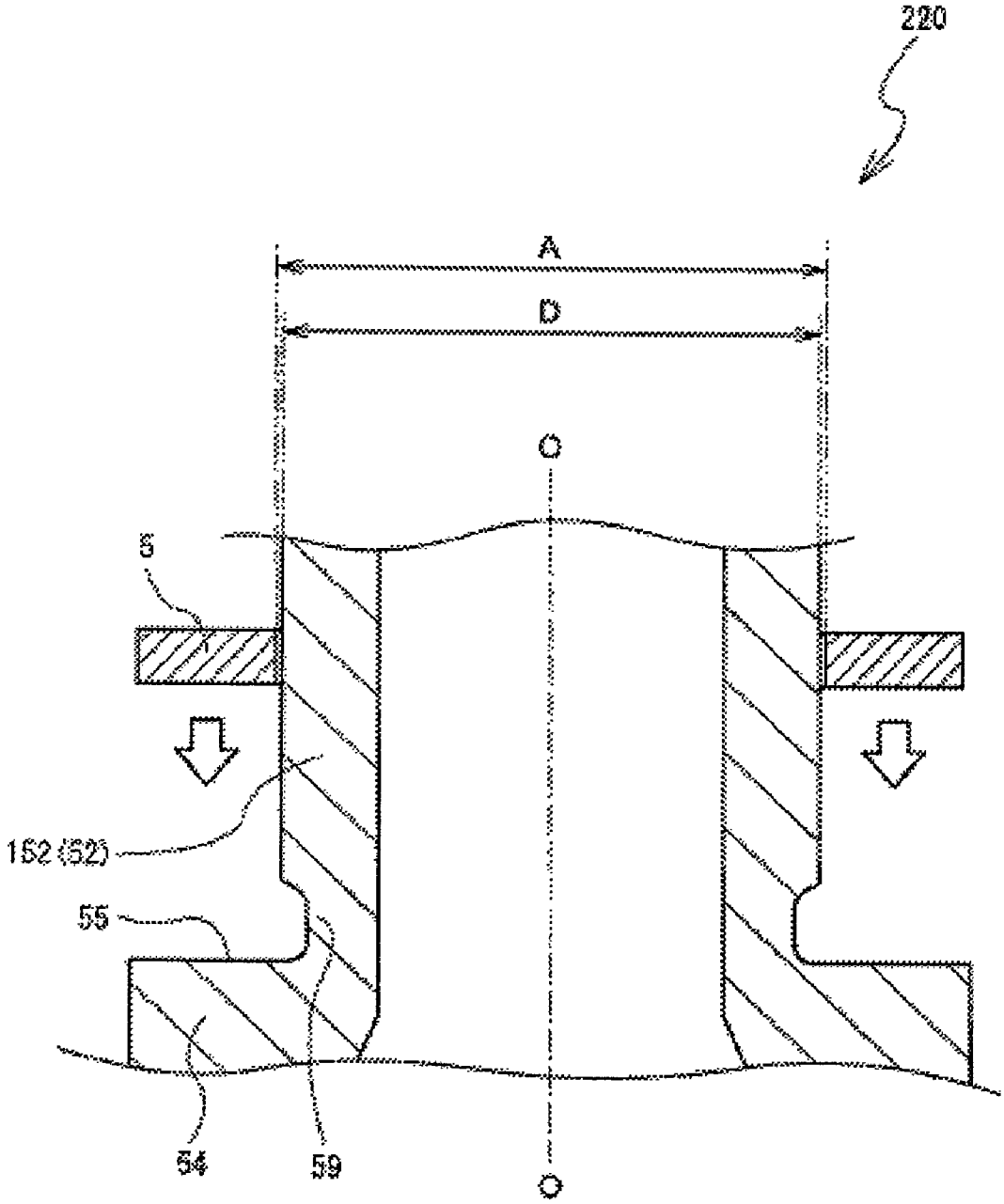
FIG. 7 is a partial cross sectional view of a cut body 220 for explaining the gasket locating step.
Figure 8:
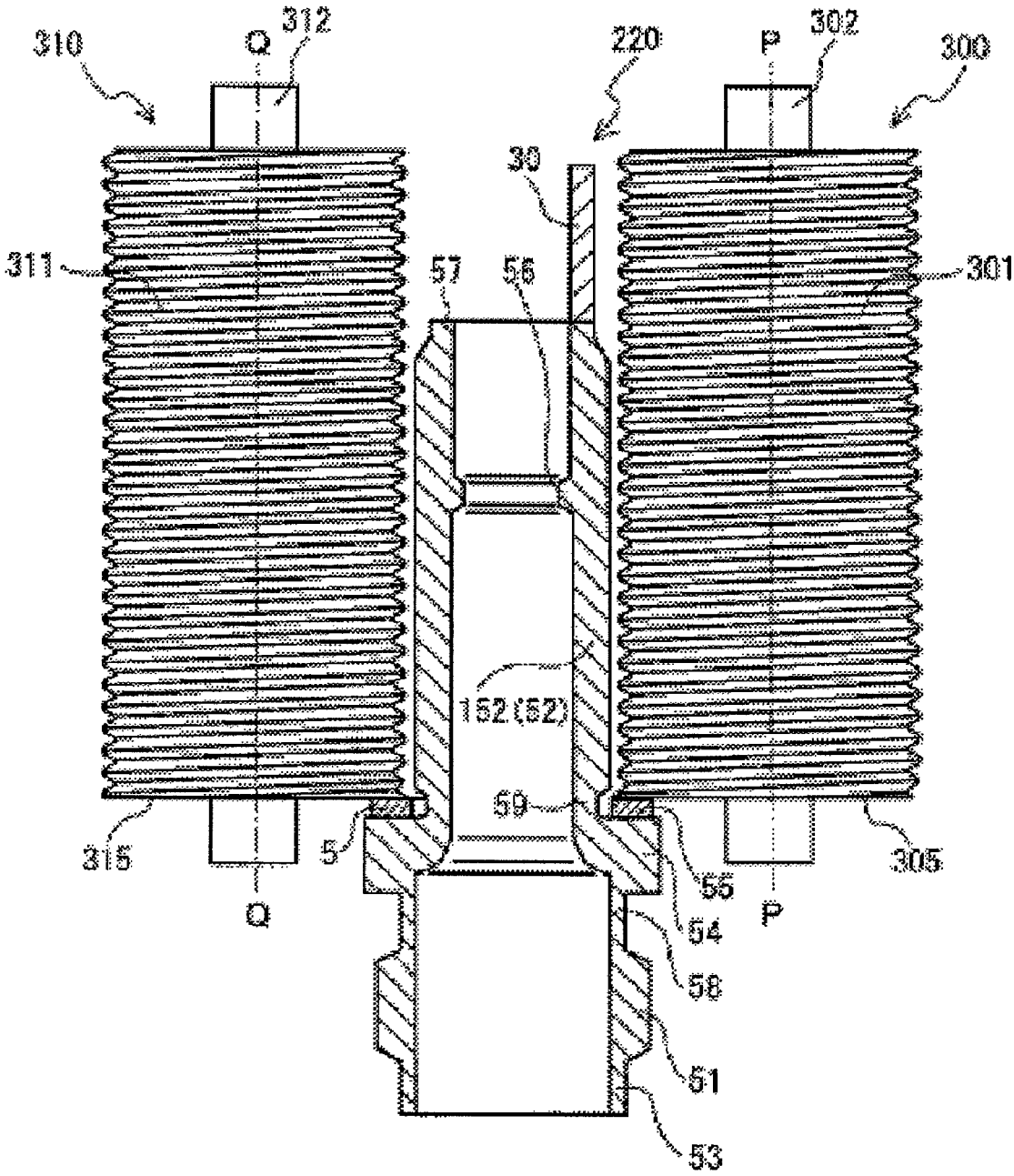
FIG. 8 shows a first thread rolling step of the manufacturing process of the spark plug 100.
Figure 10:
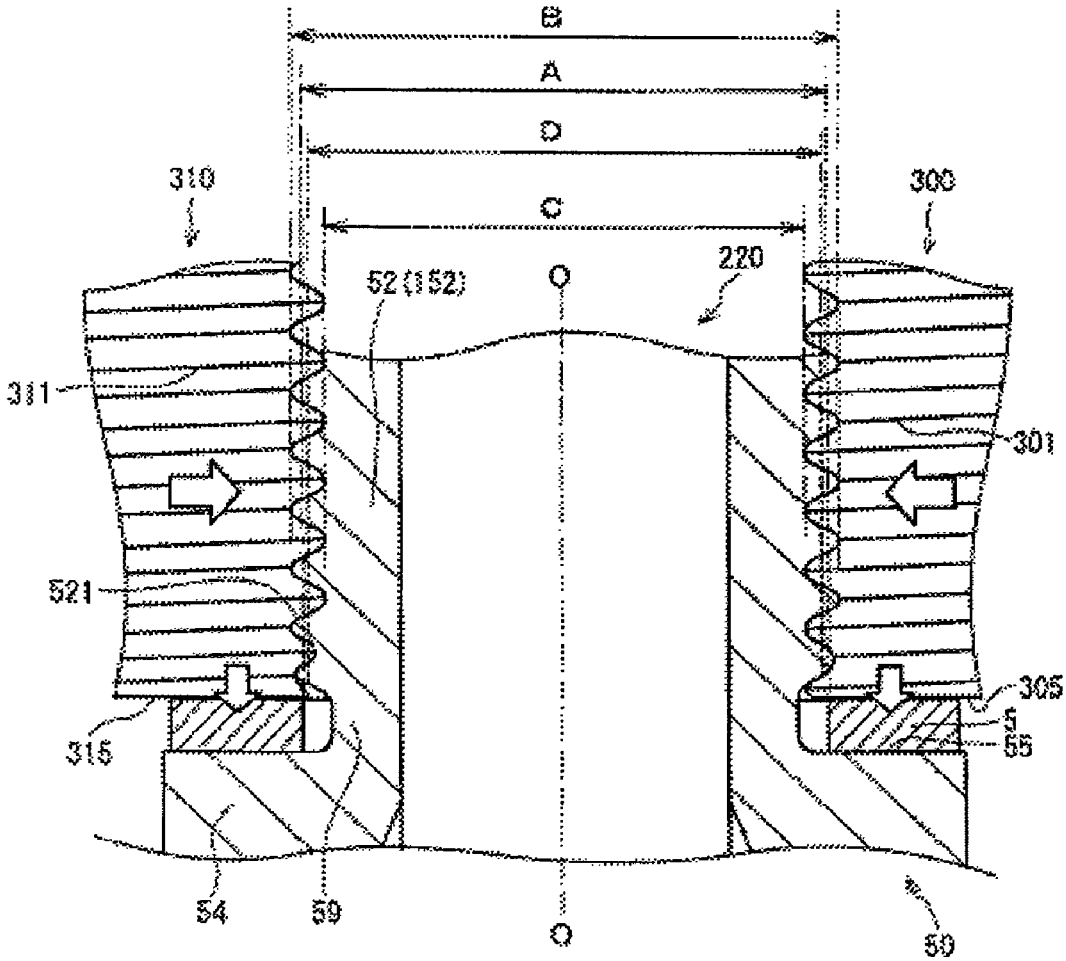
FIG. 10 is a partial cross sectional view of a cut body 220 for explaining the second thread rolling step.

In the manufacturing process for forming the spark plug 100, when producing the metal shell 50, the thread ridge 521 is formed in the thread forming portion 152 using the thread rolling cylindrical dies 300, 310 as described above. The method for manufacturing the spark plug 100 shall hereafter be described with reference to FIGS. 4 to 11. FIG. 4 shows a forging step in the manufacturing process of the spark plug 100. FIG. 5 shows a cutting step in the manufacturing process of the spark plug 100. FIG. 6 shows a gasket locating step in the manufacturing process of the spark plug 100. FIG. 7 is a partial cross sectional view of a cut body 220 for explaining the gasket locating step. FIG. 8 shows a first thread rolling step in the manufacturing process of the spark plug 100. FIG. 10 is a partial cross sectional view of the cut body 220 for explaining the second thread rolling step.

In manufacturing the metal shell 50, as shown in FIG. 4, a rod-like steel material made of low-carbon-steel material (e.g., low-carbon-steel material of 6C to 35C, such as S10C or S15C) is set to a cold forging machine (not illustrated). A forging operation, such as an extrusion molding, is conducted to form a forged body 210 serving as the manufactured metal shell 50. The cylindrical forged body 210 has a through hole 215 used for accommodating the insulator 10. The outer periphery of the forged body 210 is formed to include a rear end side cylindrical portion 211 to be used in forming the caulking portion 53, the tool engagement portion 51 and the buckling portion 58, an intermediate cylindrical portion 212 to be used in forming the seal portion 54 and a front end side cylindrical portion 213 to be used in forming the locating portion 59 and the thread forming portion 152 (fitting thread portion 52 after forming the thread ridge 521). The intermediate cylindrical portion 212 and the front end side cylindrical portion 213 are formed in a cylindrical shape, and the rear end side cylindrical portion 211 is formed in a hexagonal shape so as to engage with an outer shape of the manufactured tool engagement portion 51 (refer to FIG. 1). It is noted that forged body 210 may be formed of a low-carbon-steel material in a rod shape, or may be made from a pipe-like steel material.

Next, the forged body 210 is set to a cutting machine (not illustrated) so that the outer circumference face thereof and the inside of the through hole 215 are cut, i.e., machined, into the respective shape of the metal shell 50. That is, in the through hole 215, the front end side is cut to form the step portion 56, and through hole 215 is cut, i.e., machined, to establish a clearance (refer to FIG. 1) between an inner wall of the through hole 215 and the long leg portion 13 when receiving the insulator 10 in the through hole 215 in the assembly of the spark plug 100. Further, the caulking portion 53 having an annular outer circumference face and the buckling portion 58 is formed in the rear end side cylindrical portion 211, and the tool engagement portion 51 is formed in the remainder. The tool engagement portion 51 is not necessarily a hexagonal shape, but may be other shape, such as a BI-HEX shape.

The seal portion 54 is formed in the intermediate cylindrical portion 212, and the thread forming portion 152 which has not yet had the thread ridge 521 is formed in the front end side cylindrical portion 213. As mentioned above, the blank diameter D of the thread forming portion 152 is cut so as to be smaller than the inner diameter A (refer to FIG. 3) of the gasket 5 produced in a separate step. Further, the groove-like locating portion 59 is formed between the seal portion 54 and the thread forming portion 152.

Subsequently, as shown in FIG. 6, the base end portion 32 of the ground electrode 30 (produced in a separate step) is joined for example, by resistance welding to the front end face 57 of the cut body 220. The cut body 220 is oriented so that the front end face 57 faces upwards or sideways, and the gasket 5 produced in a separate step is inserted from the front end side of the cut body 220 so as to slide over the thread forming portion 152. As shown in FIG. 7, since the blank diameter D of the thread forming portion 152 of the cut body 220 is smaller than the inner diameter A of the gasket 5, the gasket 5 slides or slips past the thread forming portion 152 and reaches the locating portion 59. Thus, the gasket 5 can be in contact with the seat face 55 of the seal portion 54.

Next, the thread ridge 521 is formed in the thread forming portion 152 of the cut body 220 with the thread rolling. As shown in FIG. 8, in this embodiment, the cut body 220 is supported pivotally with a holding jig (not illustrated) so as to rotate about its central axis, i.e., around the axis O, see FIGS. 1 and 3. Cut body 220 is disposed, i.e., sandwiched between the thread rolling cylindrical dies 300, 310 that are dimensioned to form the thread ridge 521.

First, the rotation axes 302, 312 of the thread rolling cylindrical dies 300, 310 are moved by a driving means (not illustrated) to a position where each processing face 301, 311 does not touch the cut body 220, and an edge portion of each end face 305, 315 contacts the gasket 5 disposed on the locating portion 59 of the cut body 220. The gasket 5 abuts the seal portion 54, which prevents further movement towards the rear end side in the axis O direction. In this respect, the gasket 5 is pressed by each end face 305, 315 of the thread rolling cylindrical dies 300, 310 so as to be located on the locating portion 59. The end faces 305, 315 prevent gasket 5 from moving towards the front end side in the axis O direction.

With the gasket 5 maintained on the locating portion 59, as shown in FIG. 9, each rotation axis 302, 312 slides inward toward each other in the direction where the axis P and the axis Q can join together so that the cut body 220 is sandwiched between the thread rolling cylindrical dies 300, 310.

Then, portion 152 of the cut body 220 is pressed by the processing face 301, 311 of the thread rolling cylindrical dies 300, 310 to thereby create, i.e., thread, the thread ridge 521. As mentioned above, the thread rolling cylindrical dies 300, 310 rotate in the same direction, and the cut body 220 that is sandwiched therebetween, follows and rotates the opposite direction to that of the thread rolling cylindrical dies 300, 310.

As shown in FIG. 10, an outer circumference face of the thread forming portion 152 of the metal shell 50 is plastically deformed due to the pressure from the processing tooth of the processing face 301, 311 of the thread rolling cylindrical dies 300, 310. The formed thread ridge 521 has a crest diameter B and a core diameter C, which differ from each other. As mentioned above, in this embodiment, the material of the metal shell 50, the spec of the thread rolling cylindrical dies 300, 310, the pressing conditions at the time of the thread rolling or the like are established so that the crest diameter B of the thus-formed thread ridge 521 is larger than the inner diameter A of the gasket 5. After the thread rolling, since an edge portion of the inner circumference of the gasket 5 is caught by the thread ridge 521, the gasket 5 is confined to the locating portion 59. Gasket 5 is thereby prevented from falling from the metal shell 50. Thereafter, each part such as the insulator 10 integrated with the center electrode 20 is assembled by a known technique in the metal shell 50 where the thread ridge 521 has been formed. As a result, the spark plug 100 shown in FIG. 1 is completed.

As will be appreciated by those skilled in the art, various kinds of modifications are possible in the present invention. For example, although the thread rolling dies 300, 310 for threading the thread ridge 521 are cylindrical, rolling die with a flat type or a rotary type rolling die may be used, as long as the die has a face for pressing the gasket 5 so that the gasket 5 is maintained in the locating portion 59 during the thread rolling step. Further, the cut body 220 is disposed between the thread rolling dices and allowed to slide towards an axis of the rolling dice to form the thread ridge 521 of the thread forming portion 152. In this case, the gasket 5 is controlled not to move towards the front end side of the thread forming portion 152 by the end face of the thread rolling dice. Further, along with the movement of the cut body 220, the gasket 5 may be disposed in the locating portion 59 after the thread rolling. Furthermore, when pivotally supporting the cut body 220 with a holding jig during the thread rolling, the axis O of the cut body 220 may be supported perpendicularly or horizontally.

Figure 11:
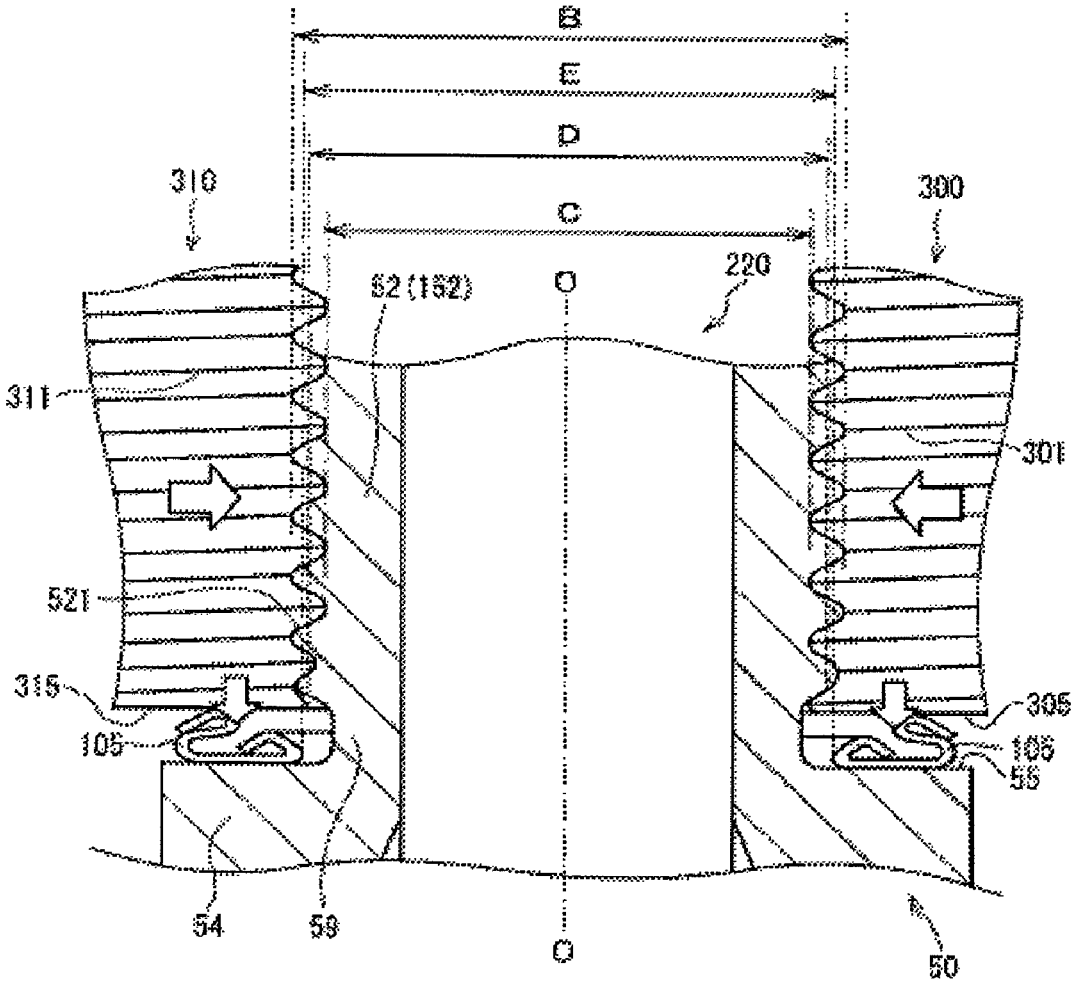
FIG. 11 is a partial cross sectional view of the cut body 220 according to a modification, which uses a hollow gasket 105.

In the embodiment heretofore described, the gasket 5 is an annular flat solid packing. As shown in FIG. 11, a spark plug may use a conventional gasket 105 assuming an S-shape or C-shape in the cross section formed by radially bending a ring-like plate material. Similar to the above embodiment, if the thread ridge 521 of the thread forming portion 152 of the cut body 220 is formed so that the initial blank diameter D before the thread rolling is smaller than the inner diameter E of the gasket 105 and the crest diameter B of the thread ridge 521 after the thread rolling is larger than the inner diameter E of the gasket 105, the gasket 105 does not fall out from the locating portion 59. Furthermore, any process is not necessary to an inner edge of the gasket 105 for preventing it from falling out whereby the manufacturing process of the spark plug may be simplified.

Although the gasket 5 is disposed on the locating portion 59 in the gasket locating step, the gasket 5 may be positioned on a front end side of the forming portion 152 away from the locating portion 59. In this case, the gasket 5 may be pressed, i.e., moved, by the end face 305, 315 of the thread rolling cylindrical dies 300, 310 in the first thread rolling step to allow the gasket to be positioned in the locating portion 59.

The present invention may be applicable to one, such as a spark plug, a temperature sensor or a gas sensor, having a gasket for preventing a gas leaking through a mounting bore where a metal shell is fitted.

The invention claimed is:

1. A method for manufacturing a spark plug having:

a center electrode;

an insulator having an axial bore which extends in an axial direction, said insulator holding the center electrode in a front end side of the axial bore; and a metal shell surrounding and holding a radial circumference of the insulator and having a male-screw-shaped fitting thread portion formed on the outer surface of a front end side of the metal shell, a seal portion formed so as to project radially outwardly at a rear end side of the metal shell relative to the fitting thread portion, and a locating portion formed between the seal portion and the fitting thread portion, where an annular gasket is disposed on said metal shell so as to form a seal between an opening peripheral portion of a fitting threaded hole of an internal-combustion engine and the seal portion of the metal shell when screwing the fitting thread portion of the metal shell into the fitting threaded hole of the internal combustion engine, wherein the method for manufacturing a spark plug comprising the steps of:

forming a cylindrical member which serves as an original form for the metal shell and where the seal portion and the locating portion are formed but no fitting thread portion is formed;

disposing a gasket on an outer circumference face of the cylindrical member;

pressing the gasket disposed on the outer circumference face of the cylindrical member towards the seal portion with a die for thread rolling, said die for thread rolling having an end face with an edge portion, wherein said edge portion of said end face of said die for thread rolling contacts and presses said gasket against said seal portion on said metal shell such that further movement of said gasket towards said rear end side in the axial direction is prevented and said gasket is disposed on the locating portion of said cylindrical member compressed between said die and said seal portion; and forming a fitting thread portion with said die for thread rolling on a thread forming portion of the cylindrical member.

2. A method for manufacturing a spark plug according to claim 1, wherein an inner diameter of the gasket is larger than an outer diameter of the thread forming portion, and wherein a maximum outer diameter of the thread ridge after the fitting thread portion formation step is larger than the inner diameter of the gasket.

3. A method for manufacturing a spark plug according to claim 1, wherein the gasket is an annular plate.

4. A method of forming a metal shell for a spark plug, comprising the steps of (a) forming an elongated metal member having:

an elongated central opening extending axially therethrough, said opening dimensioned to receive an insulator for holding a central electrode, an outwardly extending flange having an axially-facing annular surface, an elongated cylindrical section extending from said annular surface, said cylindrical section having an outer diameter, and a locating section between said annular surface and said cylindrical section;

(b) positioning an annular gasket having an inner diameter on said locating section of said metal member by sliding said gasket over said cylindrical section;

(c) pressing said gasket toward said annular position with a die for thread rolling, said die for thread rolling having an end face with an edge portion, wherein said edge portion of said end face of said die for thread rolling contacts and presses said gasket against said seal portion on said metal shell such that further movement of said gasket towards said rear end side in the axial direction is prevented and said gasket is disposed on said locating section compressed between said die and said seal portion; and (d) forming a screw thread on said cylindrical surface of metal member with said thread-rolling die applied thereto, wherein said screw thread has a crest diameter greater than said inner diameter of said gasket.

* * * * *